United States Patent [19]

Fujii et al.

[11] 4,173,124

[45] Nov. 6, 1979

[54] BOILER FEED WATER PUMP CONTROL SYSTEMS

[75] Inventors: Katsumasa Fujii, Tokyo; Naoshi Takeda, Fuchu, both of Japan

[73] Assignee: Tokyo Shibaura Kenki Kabushiki Kaisha, Kanagawa, Japan

[21] Appl. No.: 875,896

[22] Filed: Feb. 7, 1978

[30] Foreign Application Priority Data

Feb. 8, 1977 [JP] Japan ..... 52-12843

[51] Int. Cl.[2] ..... F01K 13/02

[52] U.S. Cl. ..... 60/667; 60/646; 122/451 R

[58] Field of Search ..... 60/643, 645, 646, 660, 60/664, 665, 667, 670; 122/451 R

[56] References Cited

U.S. PATENT DOCUMENTS 3,972,196 8/1976 Silvestri, Jr. ..... 60/670

FOREIGN PATENT DOCUMENTS 69903 9/1973 Japan .

*Primary Examiner*—Allen M. Ostrager

*Attorney, Agent, or Firm*—Stevens, Davis, Miller & Mosher

[57] ABSTRACT

The boiler feed water system is provided with a motor driven feed water pump and a steam turbine driven feed water pump. The control system comprises a digital computer including a flow quantity control system responsive to the degree of opening of a flow control valve and the discharge quantity of the motor driven feed water pump for controlling the flow quantity thereof, and a speed control system responsive to the speed and discharge flow quantity of the steam turbine driven feed water pump, head pressure of the feed water system and the operation of a control motor for a steam control valve of a pump driving turbine. The control is switched between the flow quantity control system and the speed control system in accordance the load of the plant.

5 Claims, 16 Drawing Figures

BOILER FEED WATER PUMP CONTROL SYSTEMS

BACKGROUND OF THE INVENTION

This invention relates to a control system of a boiler feed water pump, and more particularly a system of controlling the quantity of water fed to a boiler of a steam electric power generating plant.

As shown in FIG. 1, usually, each unit of a steam electric power generating plant is provided with two steam turbines 50*a* and 50*b* for driving feed water pumps 51*a* and 51*b* respectively, each designed to feed 50% of the water fed to a boiler under the rated load of a generator 11, and the quantity of feed water is controlled by controlling the speed of these turbines. The steam for driving these feed water turbines is supplied from the main steam pipe 52 through a bypass pipe A and a bleeder pipe B from the main steam turbine 10. However, since each of these steam sources cannot assure sufficient amount of feed water to the boiler under low load conditions of the generating unit or at the time of starting or stopping the same, an independent motor driven feed water pump 53 is installed. Under normal load condition, the flow quantity of the feed water supplied by the pumps 51*a*, 51*b* and 53 is controlled by a boiler turbine coordination control device (hereinafter called APC and will be described later), the starting and stopping of these feed water pumps at the time of starting and stopping the generating unit, and the selective starting and stopping of the feed water pumps when the load of the generating unit varies require complicated procedures. Moreover, the dynamic characteristic at the time of starting and stopping varies greatly.

Heretobefore, the starting and stopping of the feed water pumps 51*a*, 51*b* and 53 at the time of starting and stopping the generating unit or when the load varies during the normal operation thereof have been controlled by manual operation of an operator or an analogue subloop control system which executes only a portion of various control operations.

SUMMARY OF THE INVENTION

It is an object of this invention to provide a novel boiler feed water pump control system for a steam electric generating plant which can automatically control the motor driven feed water pump and the steam turbine driven feed water pump under starting, stopping and normal operating conditions of the plant in a reliable and reasonable manner.

Another object of this invention is to provide a novel boiler feed water pump control system for a steam electric power generating plant capable of reducing the time required to start and stop the generating plant.

According to this invention there is provided a boiler feed water pump control system of a steam electric power generating plant provided with a boiler, a steam turbine driven by the steam generated by said boiler, a generator driven by the steam turbine, and a feed water system of the boiler including a motor driven feed water pump provided with a flow control valve, and a feed water pump driven by a steam turbine, said control system comprising a digital computer including a flow quantity control system responsive to the degree of opening of the flow control valve and discharge quantity of the motor driven feed water pump for controlling the flow quantity thereof, a speed control system responsive to the number of revolutions and discharge flow quantity of the steam turbine driven feed water pump, system head pressure of the feed water system, and the operation of a control motor which is used to control steam supplied to the steam turbine for driving the steam turbine driven feed water pump, and means responsive to the load of the power plant for effecting transfer between the flow quantity control system and the speed control system.

DESCRIPTION OF THE PREFERRED EMBODIMENT

A preferred embodiment of this invention will now be described with reference to the accompanying drawings. For the sake of description, the control system of this invention will be described by separating it into several sub-systems, that is a feed water system, a steam pipe system, and a control system comprising a computer.

FEED WATER SYSTEM

Figure 1:
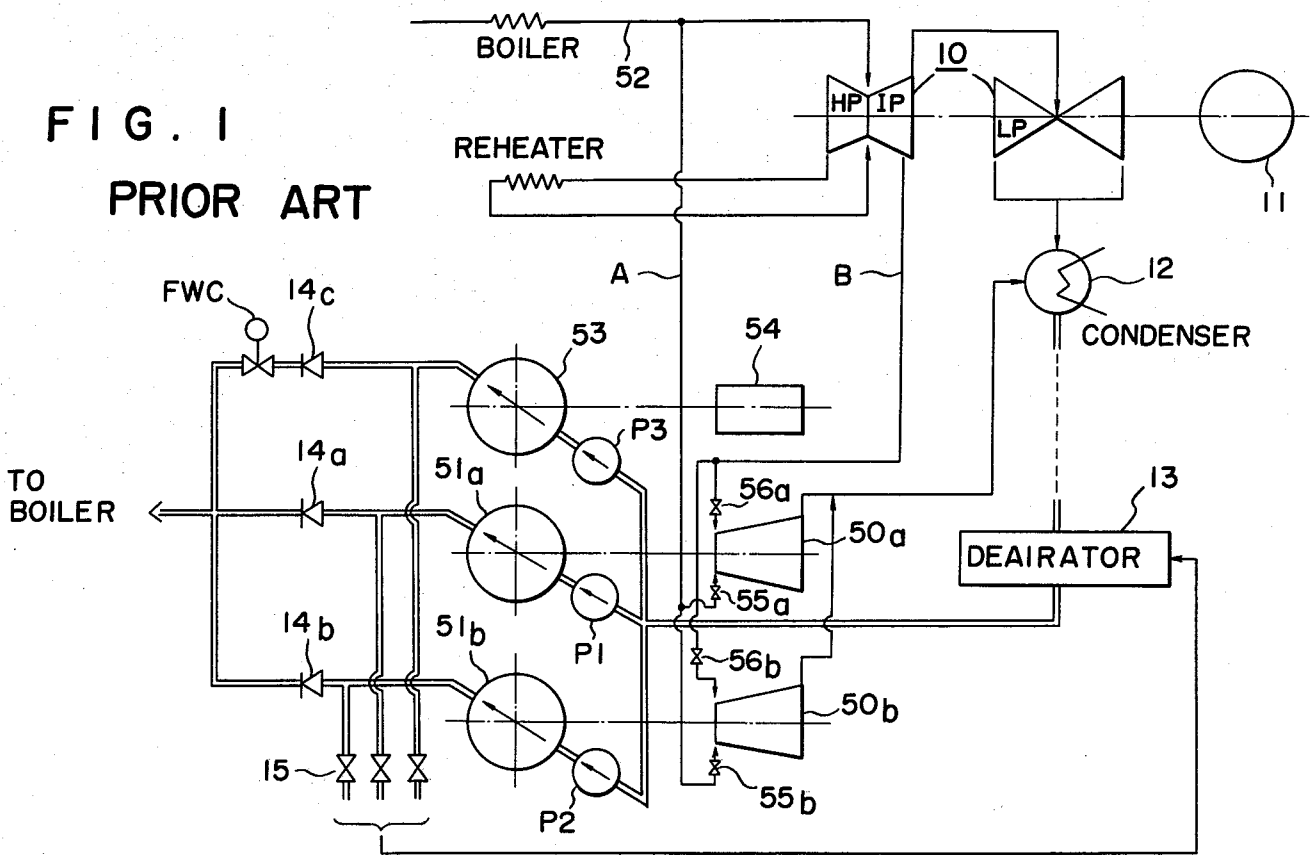
FIG. 1 PRIOR ART
FIG. 1 is a diagram showing one example of a prior art boiler feed water pump system.

The feed water system is shown in FIG. 1. Water supplied from a condenser 12 and deairator 13 is supplied to two turbine driven feed water pumps 51*a* and 51*b* and a motor driven feed water pump 53 through pumps $P_1$, $P_2$ and $P_3$ and then supplied to a boiler under high pressure. Pumps $P_1$ through $P_3$ are termed booster pumps and used over a wide speed range for the purpose of increasing the water pressure at the inlet side of respective pumps 51*a*, 51*b* and 53 to permissible maximum values determined by their characteristics.

The flow quantity of the feed water is determined by the number of revolutions of the pumps 51*a* and 51*b*, that is the speeds of their driving turbines 50*a* and 50*b*. An electric motor 54 for driving pump 53 is a constant speed AC motor, for example, an induction motor, so that the speed of pump 53 is substantially constant. Accordingly, its flow quantity is regulated by a flow control valve FWC located on the output side of pump 53. Check valves 14*a*, 14*b* and 14*c* are provided on the output sides of respective pumps 51*a*, 51*b* and 53 for the purpose of preventing reverse flow of the feed water. More particularly, while the boiler and generator 11 are operating under normal condition, the output pressure of the feed water pumps, that is the system head pressure of FIG. 1 is a pressure sufficient to supply a quantity of feed water necessary to operate the power unit but where an additional pump is started under these conditions, the output pressure of the newly started pump is lower than the system head pressure because the speed thereof is low, thus causing reverse flow. When the discharge pressure of the newly started pump reaches the system head pressure the check valve associated therewith opens to feed water to the boiler. Recirculation valves 15 are provided for protecting respective pumps against troubles caused by the inherent characteristics of the pumps in a region of low flow quantity. In such region, the output of the feed water pumps circulates through the recirculation valves 15, the deairabor 13 and the feed water pumps. These recirculation valves are closed when the flow quantity of the feed water exceeds a predetermined value. Thereafter, all quantity of the output of the feed water pumps is fed to the boiler. In the absence of the recirculation valves 15, check valves 14*a* through 14*c* are maintained closed until the output pressure of the feed water pumps reaches the system head pressure. Under such condition, the flow quantity through the pumps is zero thus overloading the same, which is of course undesirable.

Steam Pipe System

As has already been pointed out, the steam for operating the turbines 50*a* and 50*b* for driving the feed water pumps 51*a* and 51*b* is supplied through the main steam line A and the bleeder steam line B of the main turbine 10. The steam supplied through main steam line A is at a high pressure and its quantity is controlled by a high pressure control valves 55*a* and 55*b*, whereas the steam through the bleeder steam line B is at a low pressure and controlled by the low pressure control valves 56*a* and 56*b*. As above described, the quantity of the feed water is controlled by control valve FWC for pump 53 and by control valves 55*a*, 55*b*, 56*a* and 56*b* for pumps 51*a* and 51*b*.

Although the turbines 50*a* and 50*b* for driving the pump 51*a* and 51*b* can be controlled by a flow quantity control system provided for all feed water pumps, according to this invention, the speed control system for the turbines 50*a* and 50*b* and the flow quantity control system for pump 53 are made independent with each other for the following reason.

Figure 2:
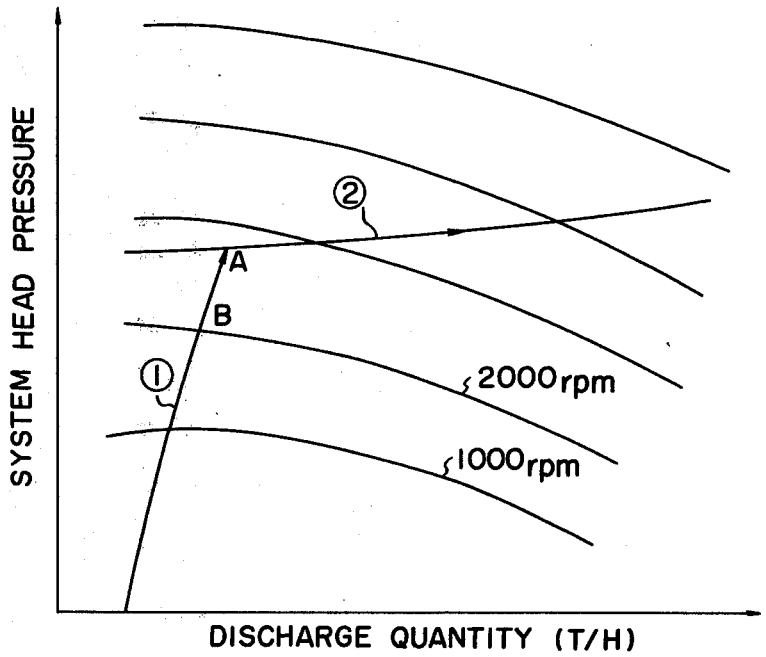
FIG. 2 is a graph showing one example of the flow quantity characteristics of a boiler feed water pump.

FIG. 2 is a graph showing one example of the discharge pressure-discharge quantity characteristics of pumps 51*a*, 51*b* and 53. As shown, the discharge pressure of pumps 51*a* and 51*b* increase with the speed thereof during starting and the discharge flow quantity increases along curve 1. At this time, however, at a point, for example B, since the discharge pressure does not yet reach the system head pressure, all quantity of the discharged water circulates through the recirculation valves 15 and no water is fed to the boiler. When the speed of the feed water pumps 51*a* and 51*b* reaches a speed represented by a point A of the system head pressure, the discharge pressure of these pumps becomes equal to the system head pressure, and as the speed of the pumps increases beyond point A their discharge quantity and discharge pressure increase along curve 2. In this range, even when the recirculation valves 15 are open, a portion of the discharged quantity is supplied to the boiler. When the recirculation valves 15 are fully closed all of the discharged quantity is supplied to the boiler. While the feed water pumps 51*a* and 51*b* are operating along curve 1, the variation in the discharge quantity is extremely small when their speed is caused to vary due to the variation in the steam pressure supplied to the driving turbines 50*a* and 50*b*. Accordingly, it is appropriate to perform a speed control in this range. On the other hand, in the case of curve 2, the discharge quantity varies greatly when pump speed is caused to vary due to the variation in the steam pressure. Accordingly, it is appropriate to perform a flow quantity control in this range.

As above described, since the steam for driving the turbines 50*a* and 50*b* is supplied from two different steam systems, and since the steam condition varies greatly (several tens times) according to the load condition of the main turbine, and in view of the importance of the thermal fatigue and vibration of the pump driving steam turbines 50*a* and 50*b*, these turbines are desired to have such characteristics as a constant rate of acceleration in the low and middle speed ranges, efficient control for warming the turbines in these speed ranges, and reducing the speed when a large vibration occurs, for the purpose of increasing the safeness and reliability. For this reason, it is necessary to provide a speed control device for the turbines 50*a* and 50*b* for use only in low and medium speed ranges.

The purpose of controlling the feed water pumps 51*a* and 51*b* is to control the quantity of feed water, and the speed control of their driving turbines is effected for the purpose of controlling the feed water quantity. For this reason, while the feed water is supplied to the boiler, it is necessary to control the feed water pumps by a flow quantity control system. To stop the feed water pumps, the discharge quantity is gradually decreased and when the discharge quantity reaches a small quantity which does not affect the operation of the plant, the feed water pumps are stopped so that it is not necessary to control the decreasing speed while the pumps are rotating at low and medium speeds. For the reason described above, the control system of the feed water pump driving turbines is constituted by a speed control system of the feed water pump driving turbines and a flow quantity control system of the feed water pumps.

Figure 3A:
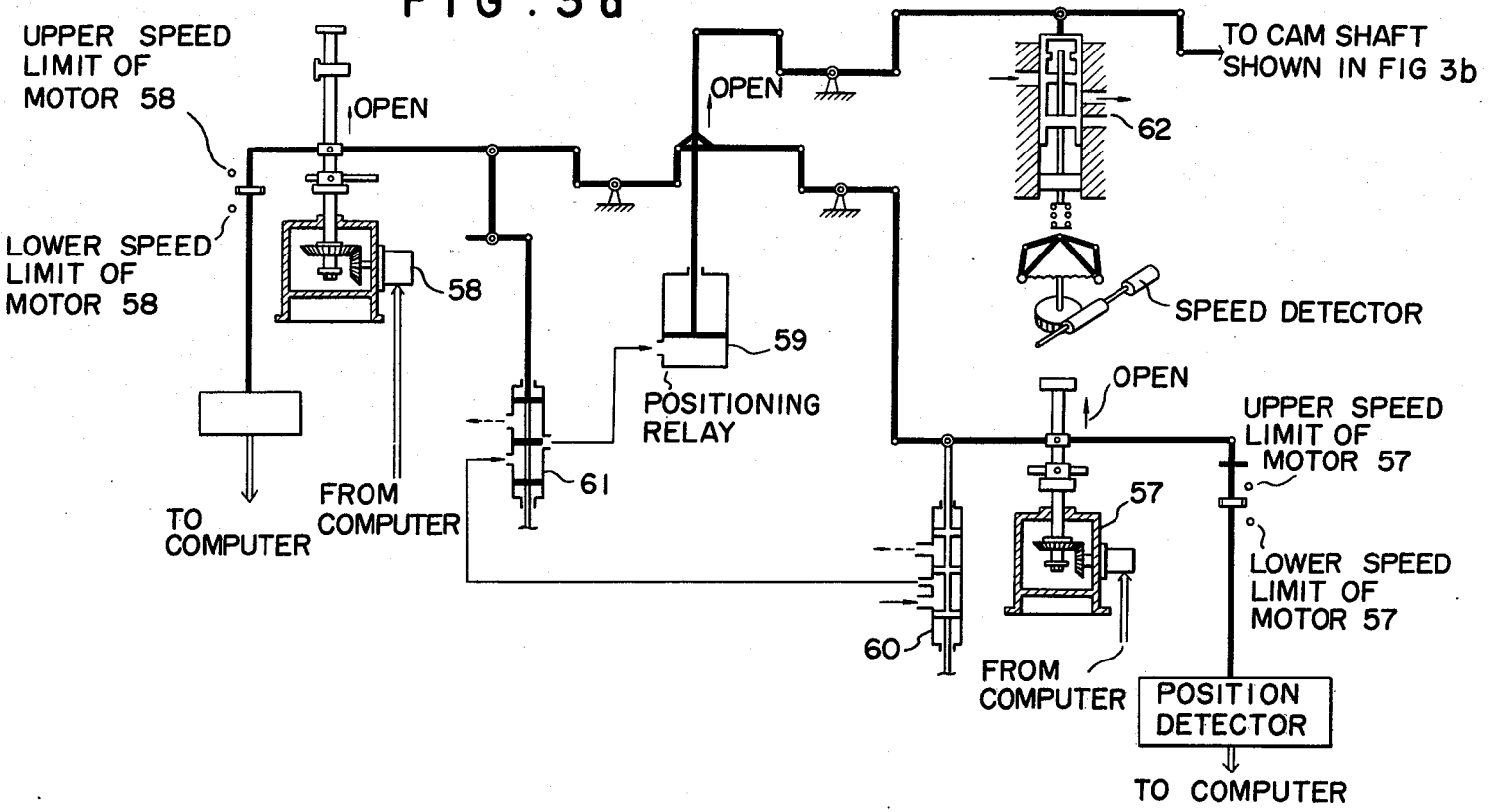
FIGS. 3*a* and FIG. 3*b* are diagrammatic representations showing one example of a motor control device for operating a turbine for driving a feed water pump.

As above described, the high and low pressure steams for driving the feed water pump driving turbines 50*a* and 50*b* are controlled by control valves 55*a*, 55*b* and 56*a*, 56*b* respectively, which are controlled by a driving mechanism including a motor 57 for operating a speed cha nger and geared a motor 58, as shown in FIG. 3*a*. The rotations of the speed changer motor 57 and the geared motor 58 are transmitted to a positioning relay 57 through links and pilot valves 60 and 61 respectively. The position of the positioning relay 59 is determined by the low value priority characteristics of the links operated by the motors 57 and 58 respectively having a high speed limit position HSS and a low speed limit position LSS. Thus, these links can operate between these limit positions.

Figure 4:
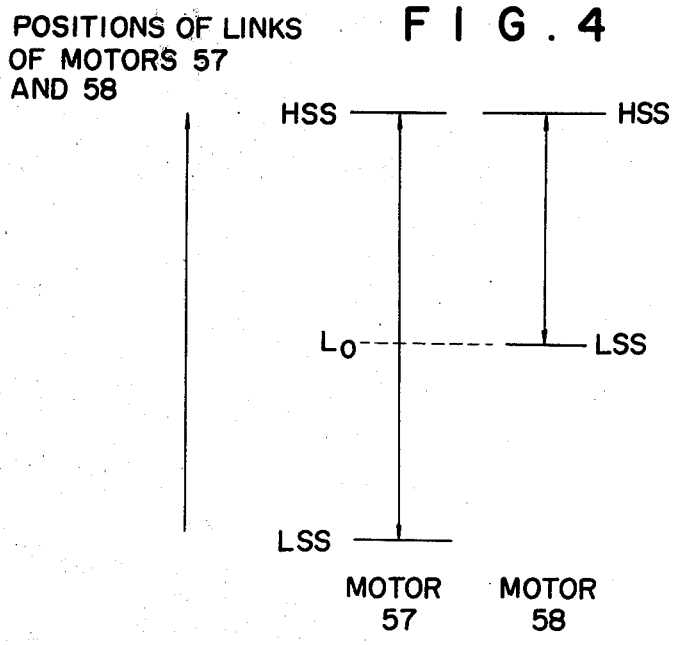
FIG. 4 is a graph showing one example of low value priority control for the control motors shown in FIGS. 3*a* and 3*b;*

FIG. 4 shows one example of the relative positions of the links in a case wherein the position of the positioning relay is determined by low value priority. As shown, the low speed limit position of motor 57 is lower than that of motor 58, so that the position of the positioning relay 59 is determined by the link operated by motor 57. While the motor 57 is accelerating to the high speed limit position HSS from the low speed limit position LSS, the motor 58 reaches the low speed limit position LSS at an intermediate position Lo. Accordingly, control action of the motor 57 is taken over by motor 58 above point Lo and the position of the positioning relay is determined by motor 58.

Figure 3B:
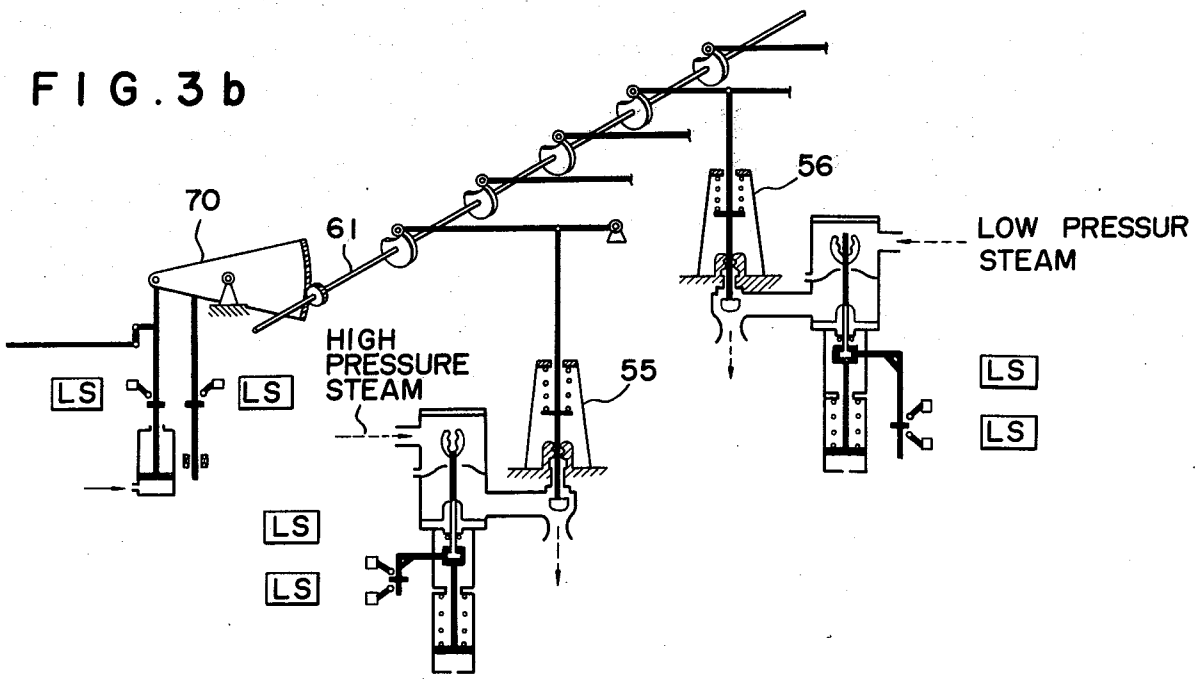
Figure 5:
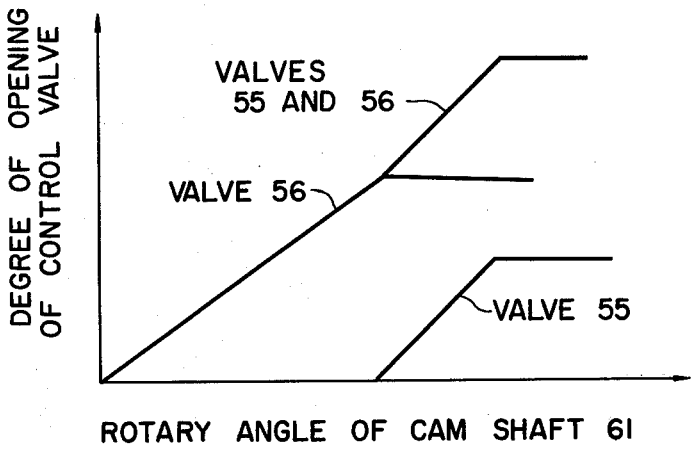
FIG. 5 is a graph showing the relationship between the cam shaft rotary angle and the openings of the steam control valves for the turbine which drives a feed water pump.

The variation in the position of the positioning relay 59 is transmitted to a cam shaft 61 for driving steam control valves through a speed relay 62 and a sector gear 70. As shown in FIG. 3*b*, the cam shaft 61 is constructed such that it firstly opens a low pressure control valve 56 and then bigins to open a high pressure control valve 55 after the valve 56 has been fully opened. FIG. 5 shows one example of the relationship between the rotary angle of cam shaft 61 and the degree of opening of control valves 55 and 56.

When supplied with steam through control valve 55 or 56, the speeds of the feed water pump driving turbine 50*a* and 50*b* increase, and when the turbine speed reaches about several tens % of the rated speed, a governor (not shown) becomes effective and its feedback control is transmitted to the cam shaft 61 via speed relay 62.

Figure 6:
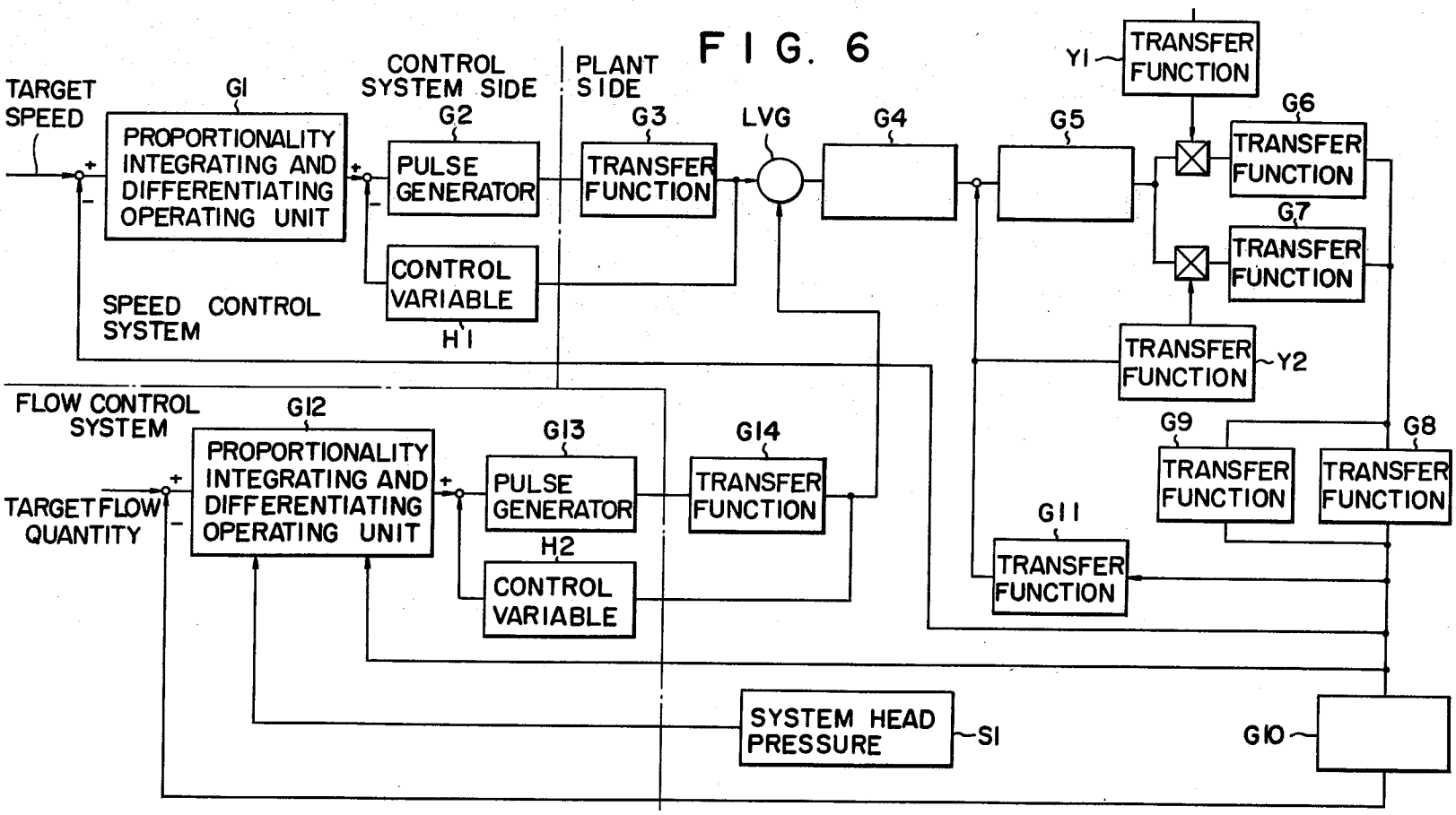
FIG. 6 is a block diagram showing a control system for the turbine driven feed water pump.

FIG. 6 is a block diagram showing a control system of the feed water pump driving steam turbines 50*a* and 50*b* which is constructed by taking into consideration the characteristics of the feed water pumps 51*a* and 51*b* which are driven by the turbines 50*a* and 50*b*. In FIG. 6, $G_3$ and $G_{14}$ are transfer functions showing the rotary angles of the motors 57 and 58, respectively, $G_4$ and $G_5$ are transfer functions showing the positioning relay 50 and speed relay 62 respectively. $Y_1$ and $Y_2$ are transfer functions showing variations in the conditions of the high pressure steam and low pressure steam, $G_6$ and $G_7$ show transfer functions representing the openings of control valves 55 and 56, $G_8$ is a transfer function showing the speed characteristic of the feed water pump driving turbines 50*a* and 50*b*, $G_9$ is a transfer function showing a loss component caused by the turbines 50*a* and 50*b*, $G_{10}$ is a transfer function showing flow characteristics of the turbine driven feed water pumps, $G_{11}$ is a transfer function showing a governor effect, and $S_1$ shows a detector for detecting the system head pressure. The operation of the block diagram shown in FIG. 6 will be described later.

One example of the starting operation by the control system described above is as follows.

Before starting, both motors 57 and 58 are at their low speed limit positions LSS. From this condition, the speed of motor 57 is increased toward the high speed limit position HSS, and the low pressure control valve 56 is opened to speed up the turbines 50*a* and 50*b* by the low pressure steam. Where such low pressure steam is not available, the high pressure control valve 55 is opened to speed up the turbines 50*a* and 50*b*. When the speed of these turbines rises to several tens % of the rated speed, the governor becomes effective. Thereafter as the motor 57 continues to operate in the direction to open the steam control valve the low value priority is given to the motor 58, thus taking over the control from motor 58. The speed at this point is designated by $N_1$, and corresponds to point B on curve 1 shown in FIG. 2. Consequently, the discharge pressure of the feed water pumps 51*a* and 51*b* is lower than the system head pressure so that the water discharged by these pumps is not fed into the boiler. From this point, the speed of motor 57 is increased to the high speed limit position HSS. However, at this time, since the low value priority is given to motor 58, the speed of the feed water pump driving turbines remains at point B shown in FIG. 2. The reason for increasing the speed of motor 57 to the high speed limit position is to always enable to give the low value priority to motor 57 after reaching such high speed limit position. When the motor 57 reaches the high speed limit position HSS, motor 58 is then operated to open the steam control valves 55 and 56 thus increasing the discharge pressure and quantity of the feed water pumps. At point A shown in FIG. 2, the discharge pressure becomes equal to the system head pressure and all discharged quantity is fed into the boiler.

According to the control system of this invention, the speed of the feed water pump driving turbines is controlled by controlling motor 57 by a speed control system up to the upper speed limit and after reaching the high speed limit position HSS, the speed of motor 58 is controlled by an independent flow quantity control system.

Generally, the feed water pump 53 is designed to have a capacity of about ¼ of the total quantity of the feed water supplied to the boiler whereas each of the feed water pumps 51*a* and 51*b* to have a capacity of one half of the total quantity. According to this invention, at the time of starting the power plant, when the feed water quantity is less than ¼ of the total quantity, feed water pump 53 is started and the control valve FWC is adjusted to supply such quantity. When the feed water quantity reaches ¼ of the total quantity, or the load of the main turbine reaches a corresponding value the first feed water pump 51*a* is started to cause it to supply ¼ of the total quantity of the feed water and the feed water pump 53 is stopped.

When the quantity of the feed water fed by the feed water pump 51*a* reaches ½ of the total quantity necessary to operate the boiler at the rated load the second feed water pump 51*b* is started.

Figure 7:
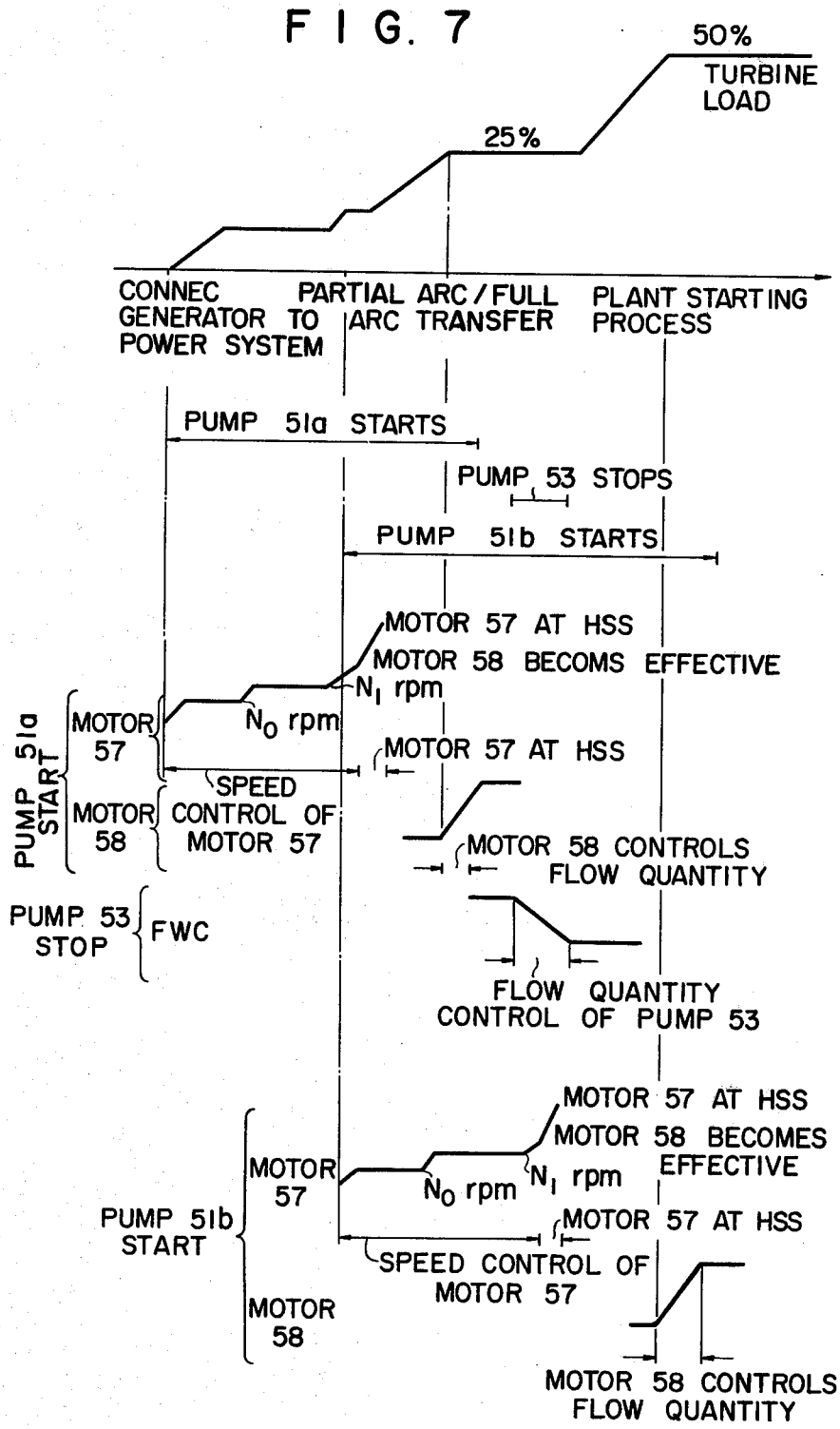
FIG. 7 is a graph showing the operations of various feed water pumps shown in FIG. 1 at the time of starting and stopping the power plant.

Although in the foregoing description, the first feed water pump 51*a* was started at a quantity of ¼ and the second feed water pump 51*b* was started at a quantity of ½ of the total quantity, in the actual operation, since a considerable time is necessary to accelerate the turbine and maintain it at a predetermined speed for alleviating the thermal stress of the turbine rotor (heat soap) before the feed water pumps begin to feed water to the boiler, for the purpose of shortening the starting time of the power unit, it is advantageous to start the first feed water pump 51*a* at the time of connecting the generator 11 to the electric system and to start the second feed water pump 51*b* at the time of switching between full arc and partial arc operations of the main turbine. This mode of operation is shown in FIG. 7.

The starting and speed control of the first and second feed water pumps 51*a* and 51*b* by motor 57 are effected after connecting the generator to the electric system and after effecting the switching between full arc and partial arc operations and the speed up and heat soaking of the turbines are effected while the load of the power plant is increasing, and completed when motor 57 reaches its high speed limit. The operation up to this point corresponds to that up to point B in FIG. 2. Under these conditions, all quantity of the water discharged by the feed water pumps is recirculated so that this operation does not affect the control of the feed water pump 53. On the other hand, since the control of feed water quantity by motor 58 corresponds to the control in a region from point B to a point beyond point A in FIG. 2 at which feeding of water to the boiler is commenced, and such control varies the quantity of feed water, as the quantity of feed water or main turbine load reaches $\frac{1}{4}$ or $\frac{1}{2}$, the control is transferred to motor 58 after maintaining the quantity of the feed water or the turbine load at a constant value for the purpose of decreasing the confusion of the feed water control system. By using the operating system described above it is possible to speed up the turbine driven feed water pumps concurrently with the increase in the load of the plant thus decreasing the starting time thereof.

Figure 8:
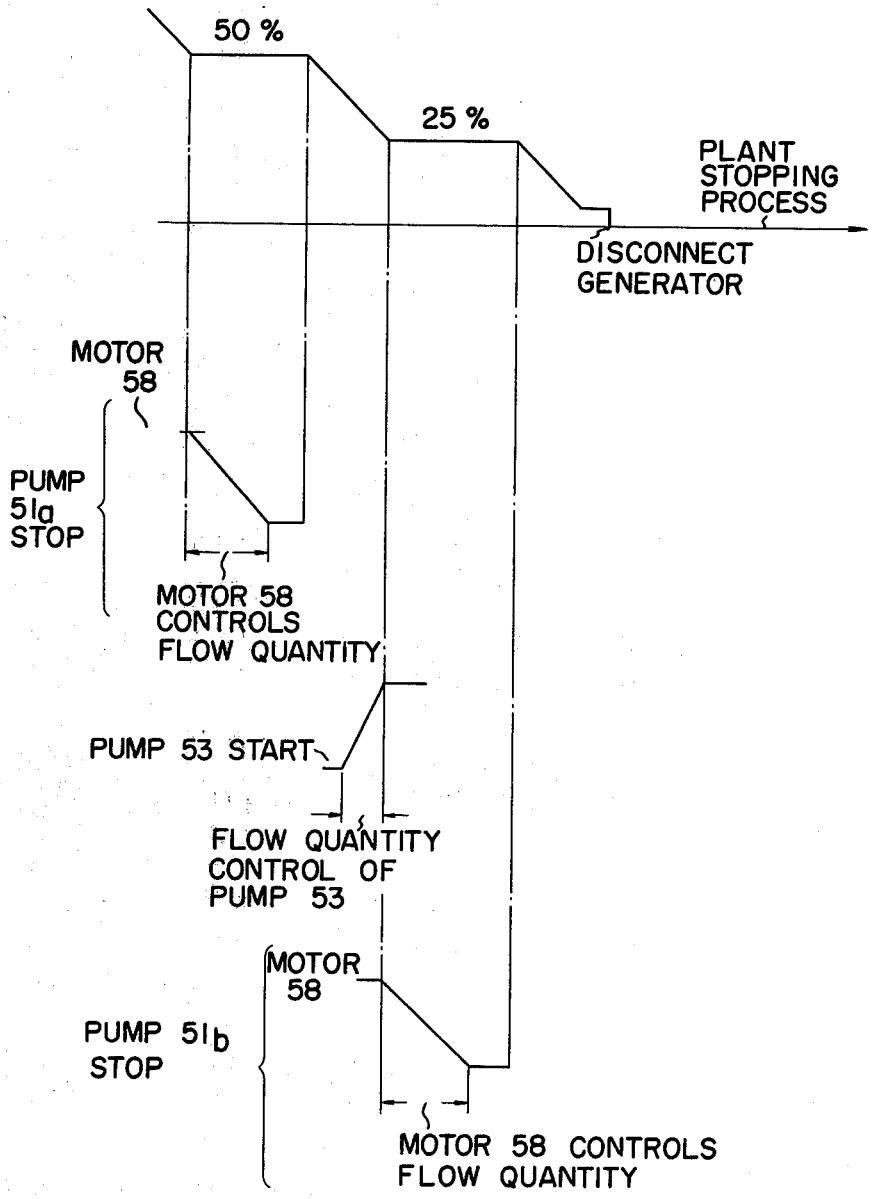
FIG. 8 is a graph showing the operations of various feed water pumps at the time of starting and stopping them when the powder plant is being stopped from 50% load.

When the quantity of the feed water or the load of the main turbine is higher than $\frac{1}{2}$ of the rated value two feed water pumps 51*a* and 51*b* are operated under the boiler turbine automatic coordination control APC to be described later. As the quantity of feed water or the main turbine load decreases to $\frac{1}{2}$ of the rated value, one of the feed water pumps is released from the automatic control and assigned to the control of motor 58 for decreasing the output of said one feed water pump. When the output of this pump decreases to a value below a predetermined value this pump is stopped. When the quantity of the feed water is about $\frac{1}{4}$ of the rated value, motor driven feed water pump 53 is started and the flow control valve FWC is controlled to increase the quantity of feed water. When a predetermined quantity is reached, the control of the flow control valve FWC is assigned to the control of APC and thereafter the second feed water pump 51*b* is released from the control of APC and assigned to the control of motor 58 so as to decrease the output of pump 51*b* and stop the same. This mode of operation is shown in FIG. 8.

In this specification, the term "normal running" is used to mean a case wherein the quantity of the feed water or the main turbine load is larger than $\frac{1}{4}$ of the rated value. When the load varies under these conditions it is necessary to start and stop the feed water pumps 51*a* and 51*b* in accordance with the capacity thereof.

Where the load increases from $\frac{1}{4}$ to above $\frac{1}{2}$ of the rated value the second feed water pump is started at about $\frac{1}{2}$ rated value. This starting is effected in the same manner as the starting of the second feed water pump when the power unit is started. On the other hand, when the load decreases from above $\frac{1}{2}$ to below $\frac{1}{2}$ of the rated value, it is necessary to stop the first feed water pump. This control is the same as that for stopping the first feed water pump when the power unit is stopped.

APC SYSTEM AND COMPUTER CONTROL SYSTEM FOR CONTROLLING FEED WATER

FIG. 9 shows one example of an APC system and a computer control system for automatically controlling a feed water system comprising one motor driven feed water pump 53 and two turbine driven feed water pumps 51*a* and 51*b*. As shown in FIG. 9, the boiler turbine automatic cordination system APC is constructed to automatically control the feed water pump 53. The term APC AUTOMATIC is used to mean a control which is performed when the movable contacts B of transfer relays X,Y and Z are thrown to stationary contacts A whereas when contacts B are thrown to stationary contacts C, an internal processing control (DCC) is effected by a computer. When pump 53 is operating, the flow control valve FWC is controlled by APC AUTOMATIC whereas when pumps 51*a* and or 51*b* are operating, motor 58 is controlled. Before entering into the APC AUTOMATIC control, that is when the contacts B of the transfer relays are thrown to contacts C, the computer controls transient variations at the time of starting and stopping by DDC.

The control object of the computer is the flow control valve FWC when the motor driven feed water pump 53 is operating, but the control object is motor 57 when the speed of feed water pumps 51*a* and 51*b* is controlled, and the motor 58 when the flow quantity of the pumps 51*a* and 51*b* is controlled. The transfer between the computer circuit and the APC circuit is effected by transfer relays X, Y and Z shown in FIG. 9*a*.

Figure 9A:
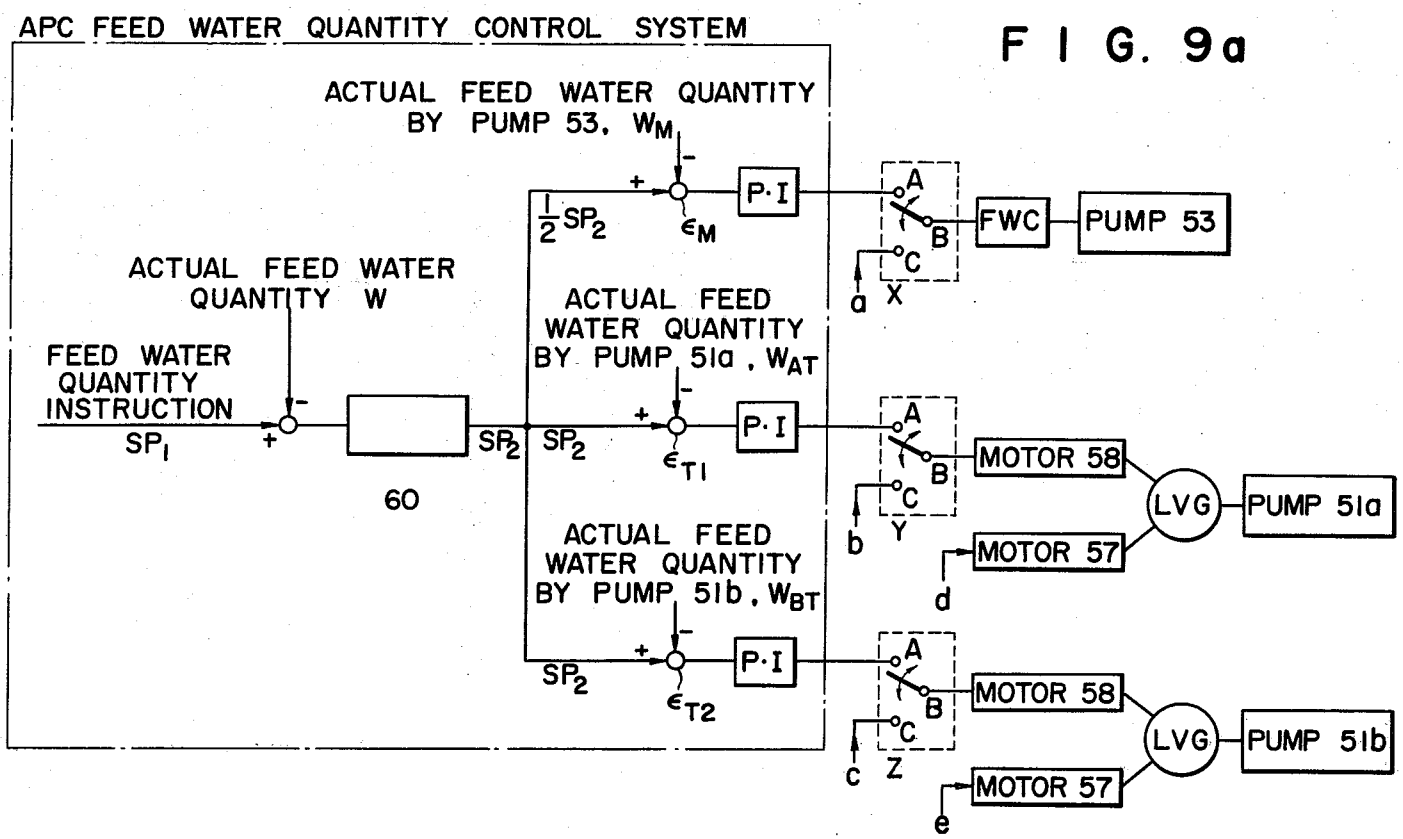
FIGS. 9*a* and 9*b* are block diagrams showing one example of a coordinated feed water control system for various feed water pumps included in a computer.
Figure 9B:
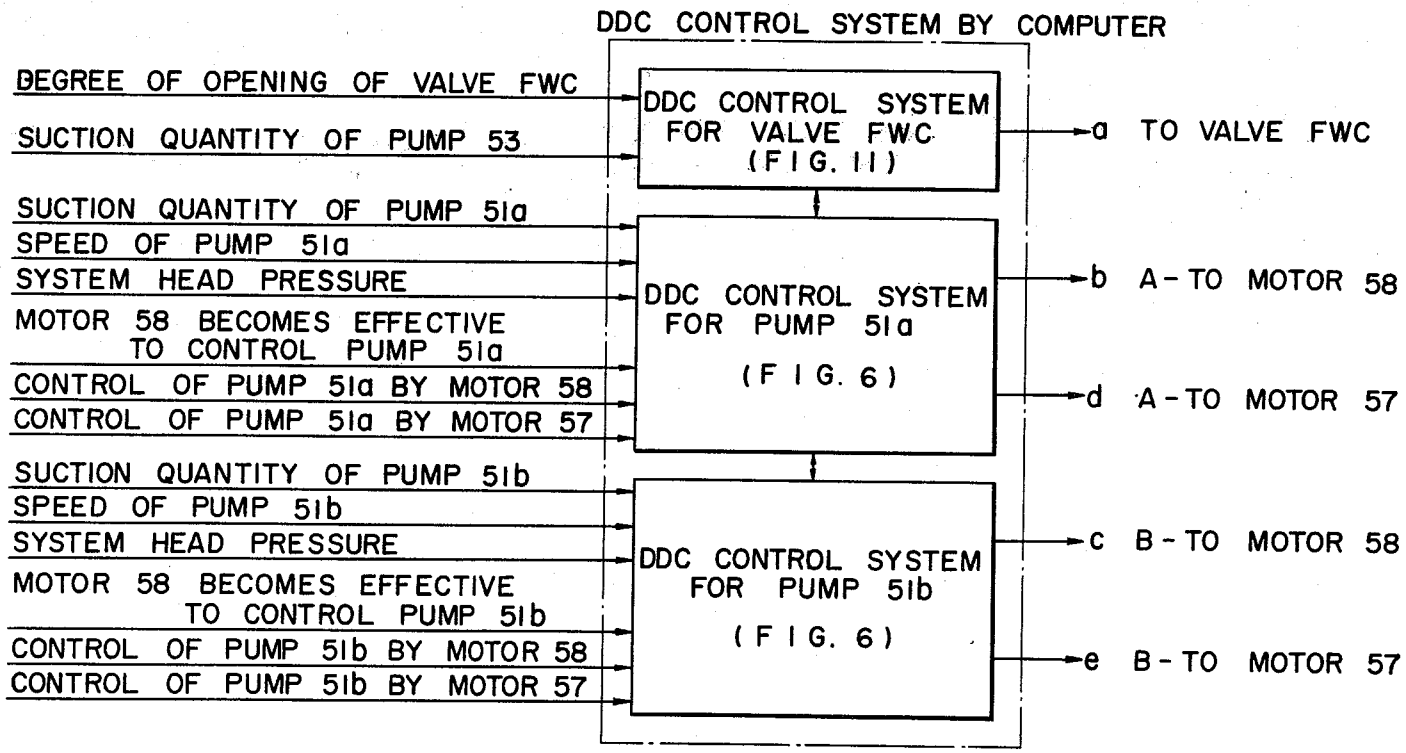

One example of the control system of the APC device for controlling the quantity of feed water shown in FIGS. 9*a* and 9*b* is as follows.

A feed water quantity instruction $SP_1$ corresponds to the total feed water quantity instruction at the inlet of the boiler and termed a "feed water master." The difference between this instruction and a signal W representing the quantity of actually fed water is supplied to a control element 60 comprising proportionality and integrating circuits and the output $SP_2$ of the control element 60 is supplied to respective feed water pumps 53, 51*a* and 51*b* according to the following ratios on the assumption that the capacity of pump 53 is one half of that of pump 51*a* or 51*b*.

Instruction to pump 53 $SPM=\frac{1}{2}SP_2$
Instruction to pump 51*a* $SPT1=SP_2$
Instruction to pump 51*b* $SPT2=SP_2$ The actual quantity of water fed by respective feed water pumps is different from the instructed values and such deviations are designated by $\epsilon_M$, $\epsilon_{T1}$ and $\epsilon_{T2}$, respectively, and such deviations are corrected by the proportionality and integrating control element 60.

Figure 10:
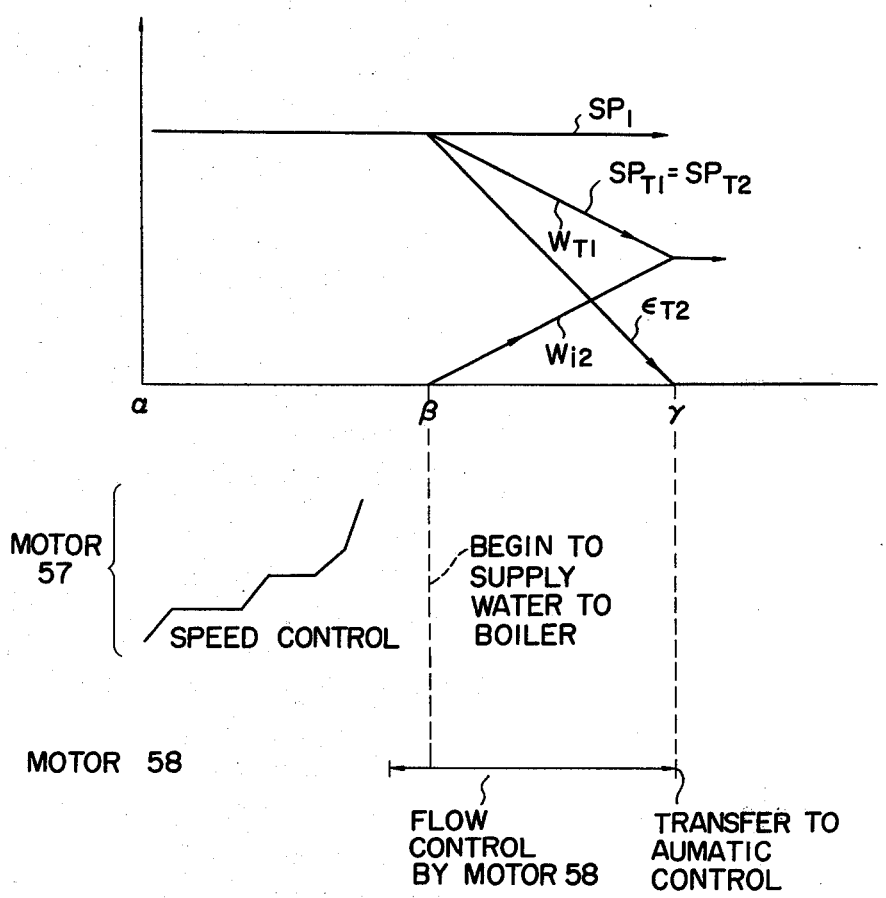
FIG. 10 is a diagram showing the starting process of a second turbine driven feed water pump when a first turbine driven feed water pump is operating under the automatic control.

As an example, the sequence of starting the second turbine driven feed water pump 51*b* at the time of starting the plant will now be described with reference to FIG. 10 showing a case wherein the first feed water pump 51*a* has been operating under the automatic control while the pump 51*b* is manually started and accelerated to increase its output, and when its output reaches a predetermined flow quantity, the pump 51*b* is assigned to the automatic control system, whereby thereafter both pumps are controlled by the automatic control system. When starting pump 51*b*, an appropriate speed control system is selected. More particularly, at first motor 57 is set to speed up pump 51*b* to its upper speed limit. Under these circumstances, however, since the output of pump 51*b* is not supplied to the boiler due to the opening of one recirculation valves 15 the operation of pump 51*b* has no influence upon the operation of the first feed water pump 51*a*. When motor 57 is controlled to reach its upper speed limit by the speed control system, the control of the pump 51*b* is assigned to motor 58. When the recirculation valve 15 is closed to supply the output of the pump 51*b* to the boiler at time $\beta$, the signal for controlling pump 51*a* varies.

At first, since the output of pump 51*b* is not supplied to the boiler. $SP_1=SP_{T1}=SP_{T2}=W_{T1}+\epsilon_{T2}=50\%$ of the feed water under normal load. However, as the flow quantity $W_{T2}$ of pump 51*b* increases after time $\beta$, the instructed quantities vary as shown in FIG. 10 under a relationship $SP_{T1}=SP_{T2}=W_{T2}$, and this relationship becomes $$SP_{T1}=SP_{T2}=W_{T1}=W_{T2} \text{ at time } \gamma.$$

Under these conditions, $\epsilon_{T2}=0$. Thus, at time $\gamma$ at which $\epsilon_{T2}\approx 0$, the control of motor 58 is transferred to the automatic control, thereby completing the starting operation of the second pump 51*b*.

As above described, by a suitable coordination between control systems of the computer for various feed water pumps, and the overall automatic control system of the plant it is possible to provide full automatic control for the starting and stopping of respective feed water pumps during starting, stopping and normal operation of the electric generating plant, thus decreasing the number and load of operators, and increasing the reliability of the control.

COMPUTER INTERNAL PROCESSING CONTROL (DDC) SYSTEM

Above described control systems utilized to control respective feed water pumps are classified into a flow quantity control of the pumps by flow control valve FWC, a speed control for the pumps by motor 57 and a flow quantity control by motor 58.

These control systems are as follows.

(1) DDC Control System of Feed Water Pumps by Flow Control Valve FWC.

Figure 11:
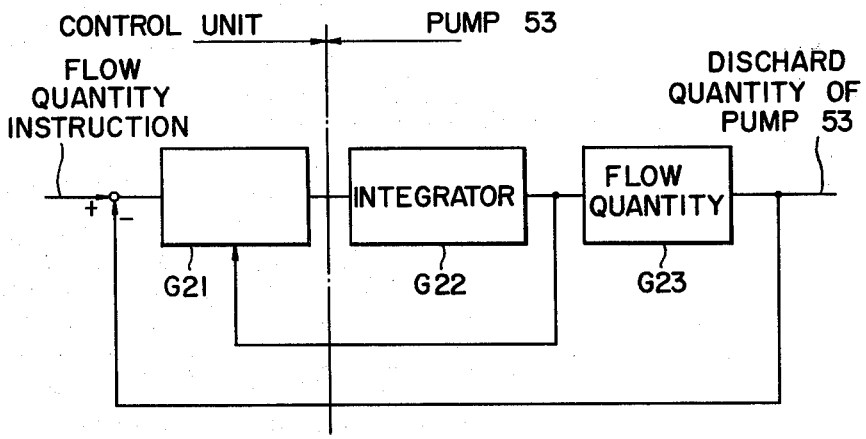
FIG. 11 is a block diagram showing the flow quantity control system of the motor driven feed water pump.

FIG. 11 shows a block diagram of this control system in which $G_1$ represents a control unit, G22 an integrating system regarding the degree of opening of the flow control valve FWC, and G23 a circuit element representing the flow quantity determined by the degree of opening of the flow control valve and includes a nonlinear element.

The principal feed back signal to G1 comprises an information regarding the discharging or suction quantity of the feed water pump while an auxiliary feed back signal comprises an information regarding the degree of opening of the flow control valve FWC. A flow quantity instruction is applied to the control unit G1 comprising proportinality and integrating units and functions to compensate for the nonlinearity of the element G23 by the degree of opening of the flow control valve FWC. The control system shown in FIG. 11 functions to control the increase and decrease of the feed water quantity during the starting and stopping operations of the power plant. In any case, the flow control valve is controlled to increase or decrease the quantity of feed water.

(2) Control System for Turbine Driven Feed Water Pumps

As above described, this sytem includes a speed control system and a flow quantity control system of the turbine driven feed water pumps. FIG. 6 is a basic block diagram showing these control systems. Since the element concerning controlled object on the righthand side of FIG. 6, have already been described, the elements on the lefthand side will be described.

(A) SPEED CONTROL SYSTEM

This system comprises a proportionality, integrating, and differentiating operating unit $G_1$ which compensates for the difference between the target speed and the actual speed of the turbine driven feed water pump, a control variable $H_1$ which is used to feed back the degree of opening of the flow control valve FCV as the auxiliary feedback signal and a pulse generator $G_2$ which supplies a pulse to motor 57 after compensating for the result of operation of a minor loop comprising $G_2$, $G_3$ and $H_1$.

(B) FLOW CONTROL SYSTEM

The flow control system comprises a proportionality, differentiating and integrating operating unit $G_{12}$ including a complicated nonlinear elements and operates to compensate for the difference between the target flow quantity and the actual flow quantity. The compensation for the nonlinearlity will be described later. Like $H_1$, $H_2$ is a control variable for feeding back the degree of the opening of the control valve provided by motor 58 and $G_{13}$ represents a pulse generator for supplying a pulse to motor 58. This control system operates to increase the quantity of the feed water at the time of starting and stopping the generating plant.

COMPENSATION FOR THE NONLINEARLITY OF THE FLOW QUANTITY CONTROL SYSTEM OF THE TURBINE DRIVEN FEED WATER PUMP

As above described, the flow quantity of the turbine driven feed water pump is controlled by motor 57 until it reaches its upper speed limit and thereafter controlled by motor 58. The speed of the feed water pump at a point when the control is transferred from motor 57 to motor 58 due to the low value priority characteristic LVG of the links is considerably higher than a speed (about several tens % of the normal speed) at which the governor of the pump driving turbine becomes effective so that when the flow quantity is controlled by motor 58, the governor is operating.

Furthermore, in a range in which the flow control is performed the conditions of the steam supplied from high pressure line A and the low pressure line B are stable so that variations $Y_1$ and $Y_2$ of the steam conditions supplied from lines A and B are not so large when compared with those prevailing when the speed control is performed. Moreover, these variations are compensated for by the governor it is not necessary to consider these variations in the flow quantity control.

One example of the relationship between the discharge quantity of a turbine driven feed water pump, the number of revolutions thereof and the system head pressure will be described with reference to FIG. 12 in which the ordinate represents the pump discharge quantity and the abscissa the speed of the pump, and the system head pressure is used as the parameter.

Figure 12:
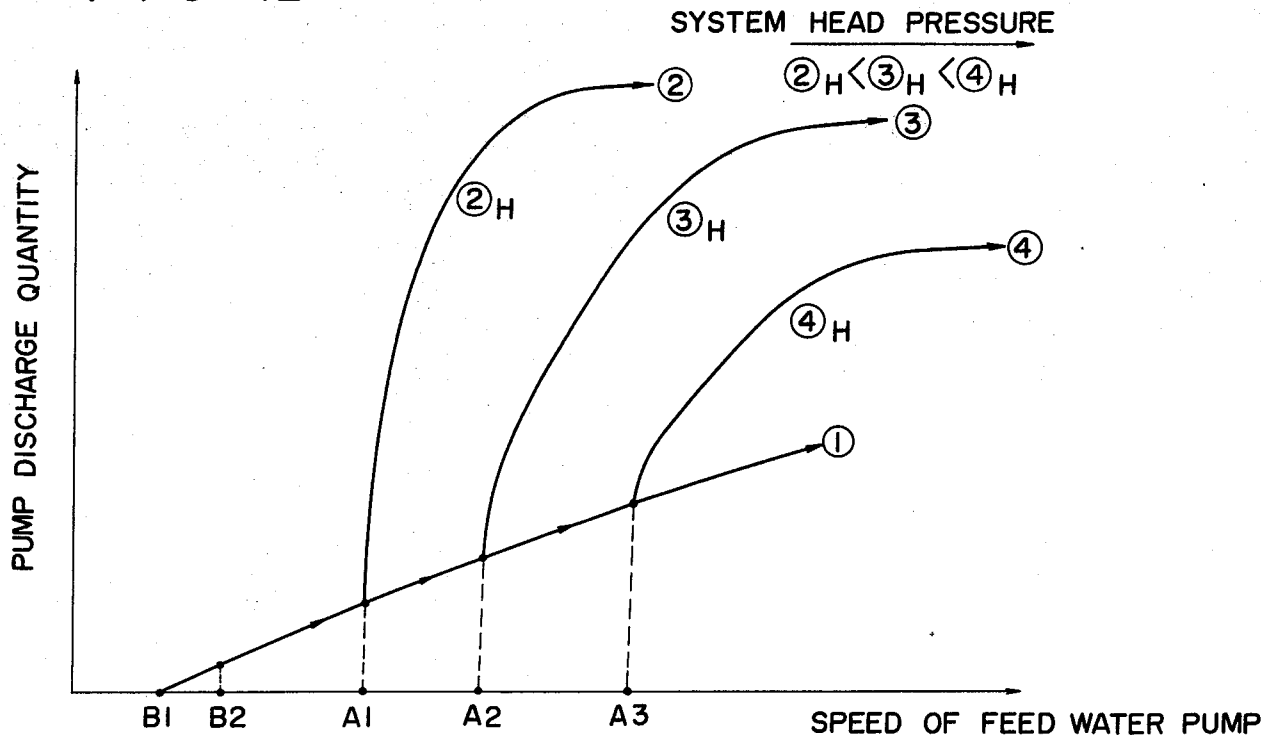
FIG. 12 is a graph showing the flow characteristics of a steam turbine driven feed water pump.

Let us explain FIG. 12 by taking a case in which the flow quantity increases. When the speed of the pump increases to $B_1$ at which motor 58 begins to control, the automatic control is started to increase the flow quantity. Until the discharge pressure of the pump becomes equal to a system head pressure, the output flow quantity increases along curve 1 as the pump speed increases. However, this output is not yet supplied to the boiler for the reason described above.

After the system head pressure and the discharge pressure of the pump have become equal at a point corresponding to speed $A_1$ of the pump, the flow quantity increases along curve 2 instead of curve 1 thus supplying a portion or all of the discharged quantity to the boiler.

Similarly, when the system head pressure becomes equal to the discharge pressure corresponding to a pump speed $A_2$ or $A_3$, the discharge quantity increases along curve 3 or 4. At speeds above $A_2$ or $A_3$ a portion or all of the discharge quantity is supplied to the boiler.

Since the low speed limit LSS of motor 58 is used for positioning the positioning relay 59, the speed at which the switching of the curves 2, 3, 4 is made varies depending upon the condition of the steam supplied to the turbine which drives the feed water pump.

Accordingly, in one case, such switching point is $B_1$, whereas in the other $B_2$. Thereafter, however, the relationship between the flow quantity control effected by motor 58 and the speed does not vary because the variation in the steam condition is compensated for by the governor as above described.

As above described, the flow quantity characteristic of the turbine driven feed water pump is not the same depending upon whether the discharge pressure is higher or lower than the system head pressure (compare curve 1 with curve 2, or 3 or 4), and flow quantity characteristic when the discharge pressure becomes equal to the system head pressure and a portion or all of the discharged quantity is fed to the boiler, also varies depending upon the load of the plant as shown by curves 2, 3 and 4. High system head pressure means a large quantity of feed water that is the plant load.

For this reason, it is necessary to compensate for all complicated nonlinear characteristics in order to control the flow quantity of the feed water pump at a predetermined rate of increase or decrease. To this end, an element for compensating the nonlinear characteritic is included in the proportionality, differentiating and integrating element $G_{12}$ shown in FIG. 6.

This can be done in the following manner. More particularly, the system head pressure and the actual number of rotations of the turbine driven feed water pump are fed back to the computer, a specific speed of the pump that can produce a discharge pressure equal to the system head pressure (pump speeds $A_1$, $A_2$ and $A_3$ at cross-points between curve 1 and curves 2, 3 and 4 in FIG. 12 correspond to such speed) and this speed is compared with the actual speed of the pump. When the actual speed of the pump is lower, that is when its discharge pressure is still lower than the system head pressure, a function utilizing the actual speed of the pump as a variable is introduced for the purpose of compensating for the nonlinearlity of the curves 2 to 4. This function is independent of the system head pressure.

On the other hand, where the actual speed of the pump is higher than the specific speed, that is when its discharge pressure has reached the system head pressure, a function utilizing the abtual speed of the pump and the system head pressure as variables is introduced for the purpose of compensating for the nonlinearity of curves 2, 3 and 4.

Above described relationships can be expressed by the following equations.

Denoting the system head pressure by PH, the actual speed of the pump by NO, and speed of pump at which its discharge pressure reaches the system pressure by NS, $$NS=f_1(PH)$$

To compensate for the nonlinearlity, the proportionality, integrating and differentiating operaing unit $G_{12}$ shown in FIG. 6 should have the following function values.

Where $$NS>NO$$

$$G_{12}=f_2(NO)$$

Where $$NS\leqq NO$$

$$G_{12}=f_3(NO,PH)$$

By this measure, it becomes possible to compensate for complicated nonlinear characteristics.

Figure 13:
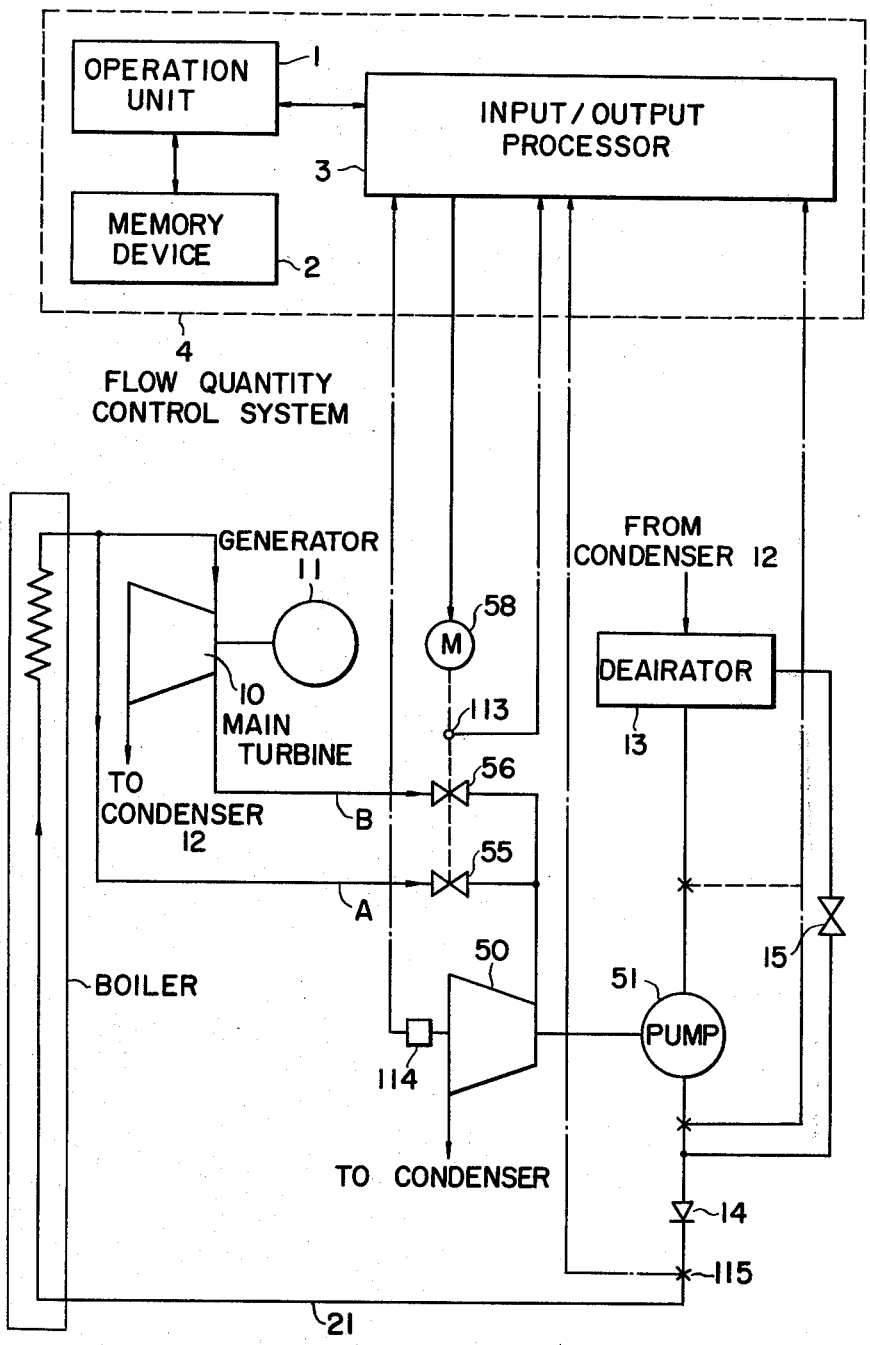
FIG. 13 is a block diagram showing one example of the flow quantity control system of the turbine driven feed water pump.

FIG. 13 shows the basic construction of the flow quantity control system.

At first controlled objects will be described.

As above described two steam systems, e.g., a steam system A from the main steam pipe and a turbine fleeder steam system B are used to drive a steam turbine 50 for driving a feed water pump 51. With the flow quantity control system 4 of this invention, for the purpose of controlling the steam flow of these two steam systems, motor 58 is operated to establish a valve opening 113 so as to determine the degree of openings of the high pressure and low pressure control valves and 56. Consequently, a quantity of steam corresponding to the degree of openings of these control valves is supplied to the turbine 50 and accelerates the pump 51.

The discharge pressure and discharge quantity of the pump 51 increase with it speed. But until the discharge pressure reaches the system head pressure, all discharge quantity is returned to a deaerator 13 in the feed water system through a recirculation valve 15.

When the speed of the pump 51 is increased by the control of motor 58 such that the discharge pressure becomes equal to the system head pressure, a check valve 14 is opened so as to feed a portion or all of the discharge quantity to the boiler through a feed water line 21.

The flow quantity control system 4 comprises a digital computer including an operation unit 1, a memory device 2 and input/output processor 3. This processor is supplied with a signal regarding the discharge quantity 16 of pump 51, a signal representing the valve opening 13 and a signal representing the system head pressure 15 and a signal representing the actual speed 114 of the turbine 50 as function values necessary to compensate for the nonlinear flow quantity characteristics of the pump 10, for performing various mathematical operations shown by the block diagram of FIG. 6 and the result of operation is supplied to motor 58 as a driving signal, thus providing a control system having high accuracy and reliability.

Instead of locating the detector of the discharge quantity of the feed water pump on the output side it may be located on the suction side of the pump as shown by dotted lines.

Figure 14:
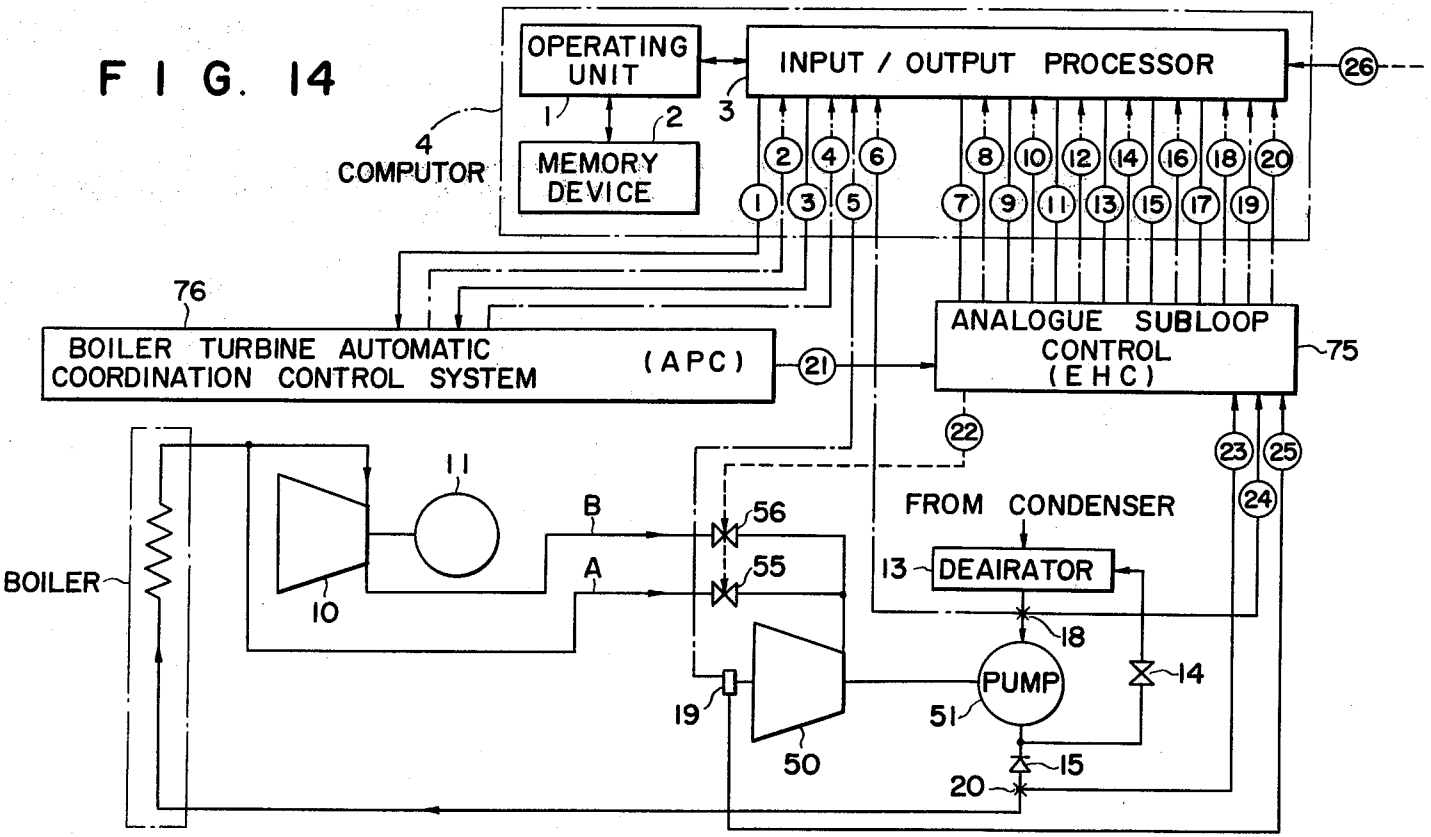
FIG. 14 is a block diagram showing a modification of this invention in which an analogue subloop control has been substituted for an internal processing control system of the turbine driven feed water pump.

FIG. 14 shows a modified control system of this invention. In this embodiment, the flow quantity control system and the speed control system of the motor driven feed water pump and the flow quantity control system of the turbine driven feed water pump are handled as an internal processing control system (DDC) of a digital computer but a portion of these control systems is replaced by analogue subloops. These control loops are selected by the computer according to the operating condition of the power plant and target values or target rates of change are instructed to the analogue sub-loops for automatically controlling the operation of feed water pumps.

As shown in FIG. 14 the control system or a digital computer 4 comprises an operation unit 1, a memory device 2 and an input/output processsor 3 which is supplied with various imput signals (26) from the plant, a signal (19) showing that motor 58 begins to operate, a signal (20) representing the upper speed limit of motor 57, a signal (5) showing the speed of the motor driven feed water pump, and a signal (6) showing the suction quantity of the turbine driven feed water pump. In response to these signals the computer judges the starting and stopping times of the turbine driven feed water pump to produce a signal (7) for selecting target speeds at respective times, a signal 9 for selecting a target rate of acceleration, a signal 11 for holding the pump speed at a prescribed value, a signal (13) for selecting a target feed water quantity, a signal (15) for selecting a target rate of change of the feed water quantity, and a signal (17) for selecting a flow quantity to be maintained, etc. These instruction signals are applied to an analogue subloop control system (EHC) 75 for causing it to perform required speed control or flow quantity control. The analogue subloop control system 75 applies confirmation signals (8), (10), (12), (14), (16) and (18) to the processor 3.

While the analogue subloop control system (EHC) 75 is operating, since APC 76 should not control the EHC 75 until a condition is reached under which the control of the pump can be switched to the automatic control, the processor 3 applies a signal (1) to the APC 76 for causing it to terminate automatic control. Then the APC sends a confirmation signal (2) to the processor 3.

When the turbine driven feed water pump 51 satisfies a condition at which its control can be transferred to automatic control (this condition is judged by the digital computer 4 based on input signals 26, 6, etc.), the computer 4 applies an automatic operation instruction signal (3) to a boiler turbine automatic coordination control system (APC) 76. In response to this instruction, tge APC 76 sends a confirmation signal (4) to the processor 3 and interconnect EHC 75 and APC 76 by a signal (21) whereby, thereafter the EHC 75 operates as an actuator of the APC 76.

In response to an instruction signal selected by the computer 4, the EHC 75 sets the degree of openings of the low pressure control valve 56 and the high pressure control valve 55 to adjust the flow quantity of low and high pressure steams, thereby forming a closed loop control system for controlling the speed of turbine 50 for driving the feed water pump 51 and the suction quantity thereof.

The nonlinearlity of the internal processing control system (DDC) for controlling the flow quantity is compensated for by directly feeding back the system head pressure (20) and the number of revolutions 19 of turbine 50 to the EHC 75 as a feedback signals (23) and (25) to perform mathematical operations necessary for nonlinearity compensation in a manner similar to that described above.

With this modification, the control system for the turbine driven feed water pump can be formed as an analogue subloop.

It is possible to substitute a digital computer for a portiion or all functions of the APC 76.

As above described, the control system of the turbine driven feed water pump comprises two independent control systems, that is a speed control system and a flow quantity control system. In the speed control system, the actual speed of the turbine or pump is controlled by motor 57 whereas in the flow quantity control system discharge or suction flow quantity of the pump is controlled by motor 58. The switching between these two control systems is done when the motor 58 begins to operate (usually at the low speed limit LSS thereof). However, the flow quantity control system can use motor 57 as in the speed control system. Since motors 57 and 58 are connected to a low value priority link mechanism, in this case the motor 58 is preset such that motor 57 would operate firstly. However, it is necessary to transfer from the speed control system to the flow quantity control system in accordance with the speed, discharge pressure or discharge quantity of the feed water pump in view of the characteristic thereof.

The system head pressure utilize to compensate for the nonlinearity of the characteristics of the feed water pump by the flow quantity control system may be the output pressure or the suction pressure of an economizer.

Although in the foregoing example, the invention has been described in terms of a generating plant provided with one motor driven feed water pump and two turbine driven feed water pumps, the number of these pumps is immaterial to this invention. Thus, the timings of starting and stopping of the pumps are varied in accordance with the number and capacity thereof.

We claim:

1. A boiler feed water pump control system of a steam electric power generating plant provided with a boiler, a steam turbine driven by the steam generated by said boiler, a generator driven by said steam turbine, and a feed water system of said boiler including a motor driven feed water pump provided with a flow control valve and a steam turbine driven feed water pump, said control system comprising a digital computer including a flow quantity control system responsive to the degree of opening of said flow control valve and discharge quantity of said motor driven feed water pump for controlling the flow quantity thereof, a speed control system responsive to the number of revolutions and discharge flow quantity of said steam turbine driven feed water pump, system head pressure of said feed water system and the operation of a control motor which is used to control steam supplied to a steam turbine for driving said steam turbine driven feed water pump, and means responsive to the load of said power plant for effecting transfer between said flow quantity control system and said speed control system.

2. The control system according to claim 1 wherein said computer comprises means responsive to the load of said power plate for starting and operating said motor driven feed water pump until said load reaches a predetermined value and for stopping said motor driven feed water pump and starting said steam turbine driven feed water pump when the load exceeds said predetermined value.

3. The control system according to claim 1 wherein said speed control system conprises a proportionality, integrating and differentiating operating unit, means for applying a signal corresponding to the difference between a target speed and an actual speed of said steam turbine driven feed water pump, a pulse generator connected to the output of said operating unit for generating a pulse for operating said control motor, and means for feeding back the output of said pulse generator to said operating unit.

4. The control system according to claim 1 wherein said flow quantity control system comprises a proportionality, integrating and differentiating operating unit, means for applying to said operating unit a signal corresponding to the difference between a target flow quantity and an actual flow quantity of said steam turbine driven feed water pump, means for applying a head pressure of said feed water system to said operating unit, means for applying a signal representing the actual speed of said steam turbine driven feed water pump, and a pulse generator connected to the output of said operating unit for generating a pulse for operating said control motor.

5. The control system according to claim 1 wherein low pressure steam and high pressure steam are supplied to a steam turbine for driving said steam turbine driven feed water pump respectively through a low pressure control valve and a high pressure control valve, a cam shaft for selectively operating said low pressure control valve and a high pressure control valve, a first control motor controlled by said computer for controlling the quantity of feed water while the load of said power plant is below a predetermined value, a second control motor controlled by said computer for controlling the speed of said steam turbine driven feed water pump when said load exceeds said predetermined value, and a low value priority linkage interconnecting said first and second control motors with said cam shaft so as to impart the priority of control to said first control motor.

* * * * *